US005946808A

United States Patent [19]

Martinez

[11] Patent Number: 5,946,808

[45] Date of Patent: Sep. 7, 1999

[54] GUIDANCE SYSTEM AND STRAIGHT EDGE FOR CUTTING VINYL OR CARPET AND FLOOR COVERING MATERIALS AND SHEET GOODS

[76] Inventor: Salomon C. Martinez, 480 Cuchara St., Denver, Colo. 80221

[21] Appl. No.: 09/074,713

[22] Filed: May 8, 1998

Related U.S. Application Data

[60] Provisional application No. 60/047,311, May 21, 1997.

[51] Int. Cl.[6] ..... B26B 1/00

[52] U.S. Cl. ..... 30/290; 30/289; 30/294; 83/745

[58] Field of Search ..... 30/289, 293, 294, 30/290, 296.1; 83/754; 33/32.2, 32.3

[56] References Cited

U.S. PATENT DOCUMENTS

| | | | |
|---|---|---|---|
| 3,394,457 | 7/1968 | Holder . | |
| 3,395,453 | 8/1968 | Prater . | |
| 3,530,579 | 9/1970 | Dahlke . | |
| 3,772,793 | 11/1973 | Anderson et al. . | |
| 4,023,273 | 5/1977 | Treleaven | 83/745 |
| 4,064,627 | 12/1977 | Zanfini . | |
| 4,429,461 | 2/1984 | Glavic . | |
| 4,505,039 | 3/1985 | Donovan | 30/289 |
| 4,635,362 | 1/1987 | Brown . | |
| 4,646,439 | 3/1987 | Squires . | |
| 4,813,141 | 3/1989 | Funger . | |
| 4,852,259 | 8/1989 | Manserra . | |
| 4,866,847 | 9/1989 | Batrack et al. . | |
| 4,903,409 | 2/1990 | Kaplan et al. . | |
| 5,083,375 | 1/1992 | Helm, Sr. . | |
| 5,353,508 | 10/1994 | Baker . | |
| 5,404,778 | 4/1995 | Ward . | |
| 5,471,753 | 12/1995 | Rodrigues . | |
| 5,485,676 | 1/1996 | Terhorst . | |
| 5,815,929 | 10/1998 | Ojea | 30/289 X |

*Primary Examiner*—Douglas D. Watts
*Attorney, Agent, or Firm*—Robert J. Gibbons

[57] ABSTRACT

This invention is directed to a device designed to cut or score floor covering materials such as vinyl, linoleum, carpet and other sheet goods. The device has a metal base with a straight edge located on the front and rear portions of the meal base. Stabilizing members fixed to the top surface of the metal base provide a support for positioning pins which hold the metal base to the carpet. When cutting vinyl of linoleum floor coverings, the positioning pins are adjusted upward and the non-slip rubber coating on the bottom surface of the metal base prevents the straight edge from moving. A first guided track is fixed to the top surface of the metal base between the front portion of the metal base and the stabilizing members. The first guided; track has a channel designed to receive a cutting member. The cutting member has a vinyl knife or a carpet knife mounted to a second guided track. The cutting member is available in a right handed version and a left handed version. The second guided track of the cutting member has a glide member which is positioned within the channel of the first guided track. As the cutting member is pulled down the length of the first guided track, the blade of the knife is guided alone the straight edge of the metal base as the blade accurately cuts or scores the floor covering material.

16 Claims, 4 Drawing Sheets

GUIDANCE SYSTEM AND STRAIGHT EDGE FOR CUTTING VINYL OR CARPET AND FLOOR COVERING MATERIALS AND SHEET GOODS

CROSS-REFERENCE TO RELATED APPLICATIONS

A provisional Patent Application of Salomon C. Martinez, Inventor, was filed on May 21, 1997, entitled "Guidance System and Straight Edge for Cutting Vinyl or Carpet and Floor Covering Materials and Sheet Goods," with a serial number of 60047311.

STATEMENT REGARDING FEDERALLY SPONSORED RESEARCH OR DEVELOPMENT

Not Applicable

REFERENCE TO A MICROFICHE APPENDIX

Not Applicable

BACKGROUND

This device relates to a straight edge guidance system for cutting carpet, vinyl, linoleum floor coverings and sheet goods.

When installing carpet at a job site, the installer will usually measure the room, lay out the tack strip, lay out the carpet pad, cut the carpet pad, lay out the carpet, and cut the carpet to fit the size of the room. At some place in the room, the installer will have to make a seam by joining two pieces of carpet together with a melt tape. The melt tape consists of a thick piece of paper having an adhesive and nylon threads deposited on one surface of the tape. The melt tape is centered below the two pieces of carpet such that the adhesive and nylon threads are in contact with the carpet backing. The installer will melt the adhesive on the melt tape with an iron, butt the two carpet edges together and then apply weight, usually the installer's tool box, to the newly formed seam.

The tools most often used by an installer to cut the carpet are a flat straight edge and a utility knife. Several problems may arise during the installation of carpet when using these tools. First, the flat straight edge can move off the line of cut during the cutting process. Second, the weight of the installer can cause the carpet to move away from the installer and off the line of cut. And third, the installer's hand can wobble during the cutting process which, in turn, causes lateral movement in the blade as the blade cuts the carpet. These three problems are all factors which influence whether the carpet has been cut in a straight fashion. It is easier to form the seam when each piece of carpet has a straight cut because the carpet edges will lay flat next to each other. If one carpet edge does not have a straight cut then the seam will be visibly noticeable.

The "double cut" is another problem that occurs when an installer uses a flat straight edge and a utility knife. The "double cut" is an industry term used to describe what happens to carpet as it is cut from the stock roll. After the required amount of carpet is pulled from the stock roll, the installer will lay the flat edge on top of the roll and cut the carpet as it sits on the stock roll with a hand held utility knife. Often the installer will put too much downward pressure on the utility knife causing the blade to cut not only the top layer of carpet but also the carpet located beneath the top layer still on the roll. This piece of cut carpet still on the roll is damaged, and if installed, the carpet yarn over time will start to unravel from the cut area.

A final problem experienced by carpet installers is what is commonly known in the industry as "seam peaking." Whenever two adjoining pieces of carpet are brought together to form a seam, the carpet edges at the seam may "peak" or lift up causing the seam to be visibly noticeable. As the installer joins the two pieces of carpet together, the hot iron is often left unattended on a section of melt tape in front of the installer. This will cause the adhesive on that section of melt tape to overheat. When the adhesive on the melt tape becomes too hot, the adhesive can run and can cause the adhesive to be distributed unevenly. Additionally, the hot adhesive will soften up the carpet backing and the thick paper on which the adhesive is deposited. This will cause the carpet backing and the thick paper to become more flexible. Together, this creates a condition at the seam where some areas of carpet backing are hotter than others, some areas of carpet backing are more flexible than others and some areas of carpet backing have more adhesive than others. As the adhesive cools, any one of these conditions can create stress at the seam which will cause the seam to "peak" or lift up.

Most of these problems resurface again when installing vinyl or linoleum floor coverings. The same tools are used to cut vinyl or linoleum floor coverings, except the installer will usually use a vinyl knife. The vinyl knife has a stronger cutting blade which is required because these floor coverings are rigid and generate a great deal of resistance when they are cut. When installing vinyl or linoleum floor coverings it is critical to have a straight cut in order to form a seam and to match a pattern. The slightest imperfection in the cut will be visibly noticeable when dealing with these floor coverings. These imperfections are caused when the straight edge moves off the line of cut during the cutting process, the weight of the installer causes the floor covering to move away from the installer and off the line of cut or there is lateral movement in the blade during the cutting process.

SUMMARY

The present device provides a solution to the above problems by combining a straight edge base equipped with a guided track and a cutting member designed to cut carpet. The cutting system includes a metal base which has a straight edge on both the front and rear portions. A guided track is then removably fixed to the metal base in the first embodiment and integral with the base in the preferred embodiment. The metal base also includes at least two removable stabilizing members each of which contains a positioning pin which holds the metal base to the carpet and prevents the straight edge from "walking" as the carpet is being cut. Therefore, once the installer has lined up the cut and locked the base of the cutting system to the carpet with the positioning pins, if the weight of the installer causes the carpet to "walk," the base of the cutting system "walks" with the carpet and preserves the line of the cut. The cutting member of the instant device includes a carpet knife with an adjustable blade permanently mounted to a track having a central glide. The glide of the cutting member when inserted into the track of the metal base causes the blade of the carpet knife to rest along the straight edge of the metal base. The side walls of the track of the metal base restricts the glide of the cutting member from moving from side to side. This restriction placed on the glide further prevents lateral movement of the blade when the blade is cutting the carpet. Since the lateral movement of the blade is restricted the newly formed carpet edge will have a straight cut. Additionally, the installer has better control of the downward pressure exerted on the cutting member as it glides down the guided track when performing the cutting task. The cutting member will not glide down the track if too much downward pressure is exerted on the cutting member.

Another feature of the cutting system is that it allows the installer to control the depth of the cut when cutting carpet. The cutting member uses a carpet knife having as adjustable blade which permits the installer to increase or decrease the length of the blade. This feature is particularly useful in preventing the "double cut" from the stock roll and in scoring the secondary backing of the carpet, infra. In preventing the "double cut," the installer can adjust the length of the blade in order to cut through only the top layer of carpet that sits on the roll.

The design of the metal base includes a straiqht edge on both the front and rear portions. This feature allows the absent minded installer, who forgets to bring the cutting member along to the job site, to continue working if a standard utility knife is present. When using the straight edge located on the rear portion of the metal base with a standard utility knife, the installer will not be able to control the lateral movement in the blade or the depth of the cut. However, the metal base will still provide the installer with a tool that has a straight edge and prevents the carpet from "walking" as the carpet is being cut.

Since all installers are not right handed, another version of the device includes a cutting member suitable for left handed installers. The left handed cutting member is modified by fixing the carpet knife to the track of the cutting member at an end opposite the end used for the right handed cutting member.

An additional feature of the cutting system is directed towards safety. When the cutting system is in use, the installer's free hand is usually positioned on the metal base behind the track which is out of the line of cut. Additionally, if the cutting member should jump the track, the installer's free hand will still be located behind the track and the cutting hand will be holding the handle of the cutting member. This will reduce the risk of injury to the installer.

The instant application also discloses a method which will greatly reduce the problem of "seam peaking" when installing carpet. In order to understand this method it is helpful to know that a piece of carpet contains staples of yarn that have been stitched together, a primary backing and a secondary backing. The staples of yarn stitched together are sewn and/or glued to the primary backing. The secondary backing, which can be described as the underside of the carpet, is adhered to the primary backing. The method teaches the installer to cut the carpet in order to obtain a carpet edge with a straight cut. The installer will then score the secondary backing of the carpet at a location between the straight edge of the carpet and the end of where the melt tape will be applied. Since normal melt tape is about 2 and ½ inches in width, the preferred method is a score in the secondary backing of the carpet at about ¾ of an inch from the straight edge of the carpet. To score only the secondary backing of the carpet, the blade on the carpet knife of the cutting member is adjusted to the appropriate length. If the primary backing is cut then the stitching holding the staples of yarn together can be cut which may cause the staples of yarn to unravel over time. The same procedure is then performed to the other adjoining edge of carpet. When the two adjoining edges of scored carpet are butted together, whatever stress is present at the seam is transferred from the straight edge of the carpet to the score. Melt tape is then applied to bond the two adjoining edges of carpet together at the seam. The score in the secondary backing of the carpet is sealed as the adhesive cools.

The cutting system can equally be used when installing vinyl and linoleum floor coverings. The positioning pins may be used to secure the metal base to the vinyl or linoleum floor coverings; however, the piercing end of the positioning pins may leave an indentation in the surface of the vinyl or linoleum floor. It is therefore recommended that the positioning pins not be used when cutting vinyl or linoleum floor coverings. Instead, the bottom surface of the metal base has a non-slip rubber coating which holds the metal base in place and preserves the line of cut during the cutting process. To use the device on vinyl or linoleum floor coverings the cutting member must be modified with a vinyl knife instead of a carpet knife. The vinyl knife uses a cutting blade which may or may not be adjustable and has a stronger blade. The vinyl knife is then fixed to the cutting member in order to accommodate the right handed installer in one version and the left handed installer in another version.

It is easy to recognize that this device provides a fast and accurate way to cut carpet, vinyl and linoleum floor coverings. However, this device is not limited to these types of floor coverings and can be adapted to cut various other materials, such as sheet rock or wall paneling, just by adapting the blade of the cutting member to cut the specified material.

BRIEF DESCRIPTION OF THE DRAWINGS

These and other features of the instant device will become clearer with regard to the following description, claims and drawings where:

DETAILED DESCRIPTION

Figure 1:
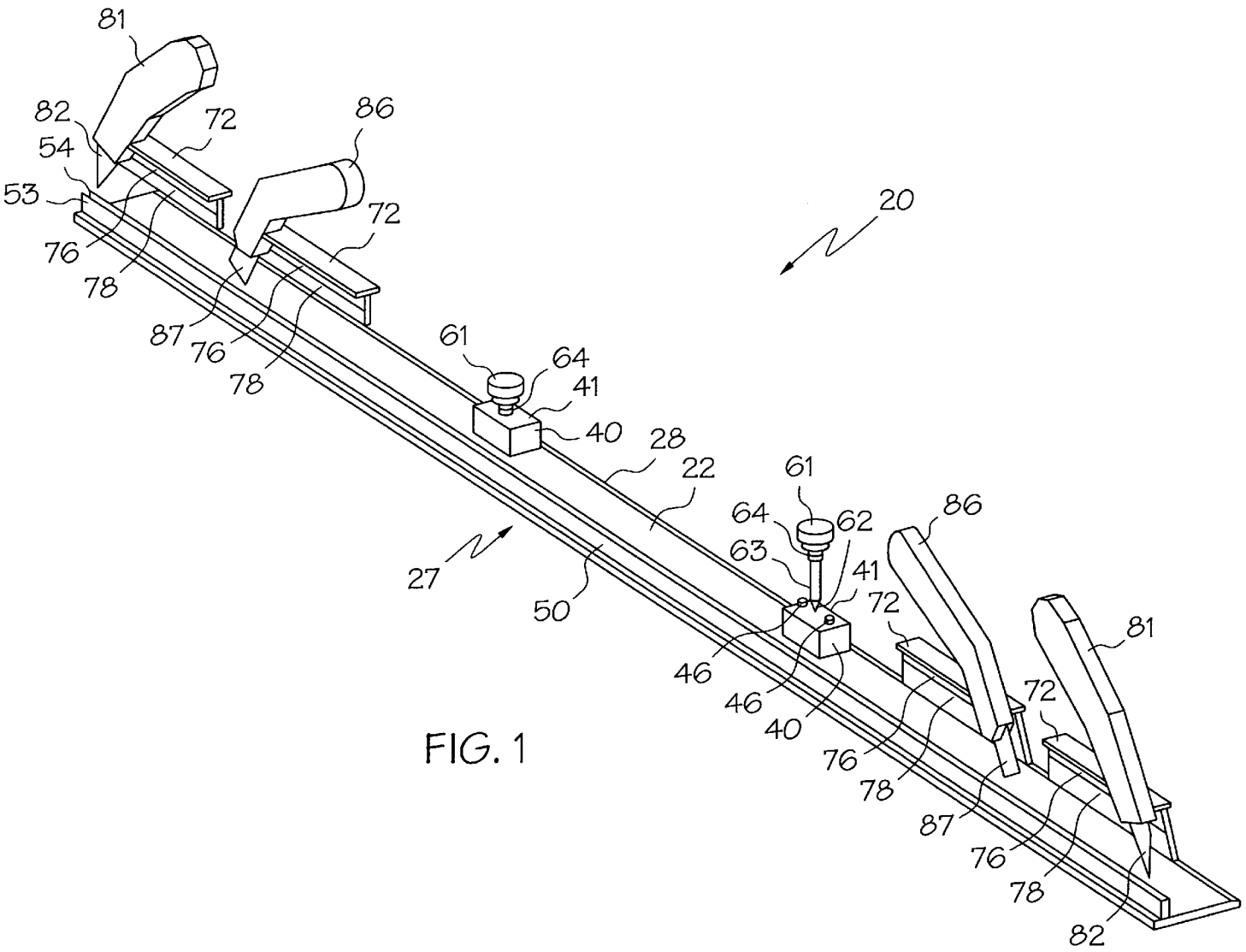
FIG. 1 shows a perspective view of the straight edge guidance system with right hand and left hand cutting members fixed with carpet knives and vinyl knives.
Figure 4:
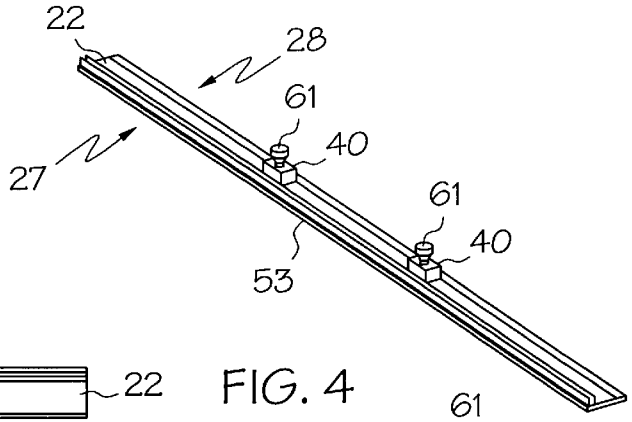
FIG. 4 shows an isometric view of the straight edge.

As generally shown in FIG. 1, a straight edge guidance cutting system 20 comprises an elongated metal base 21 made of aluminum or steel. The metal base 21 has a straight edge 27 on the front portion 24 and a straight edge 28 on the rear portion 25. In the preferred version the metal base 21 ranges from about 4 to 6 feet in length. The metal base 21 has a flat top surface 22 and a flat bottom surface 23. There at least two threaded apertures 29 between the front portion 24 and the rear portion 25 of the metal base 21. these threaded apertures 29 extend from the top surface 22 to the bottom surface 23 of the metal base 21. There is a non-slip rubber coating 30 on the bottom surface 23 of the metal base 21 between the front portion 24 and the rear portion 25 of the metal base 21.

Figure 5:
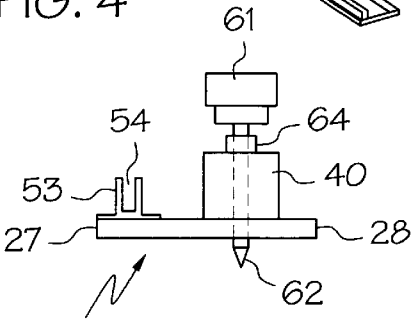
FIG. 5 shows a side view of the straight edge.
Figure 6:
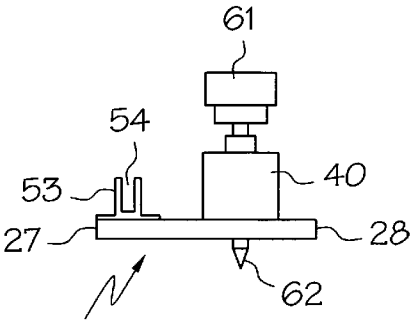
FIG. 6 shows a side view of the straight edge.
Figure 2:
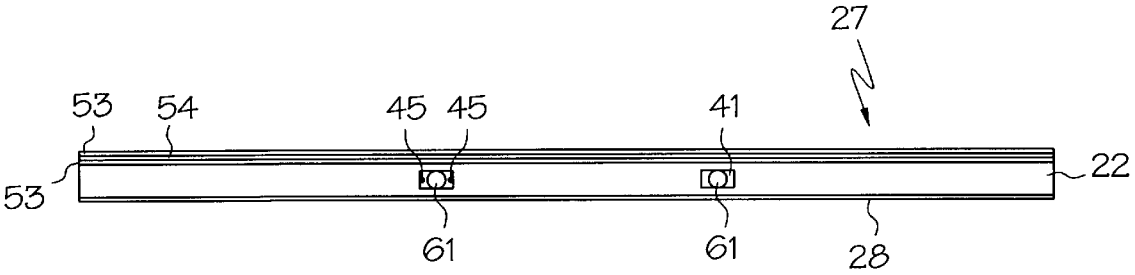
FIG. 2 shows a top view of the straight edge.
Figure 3:
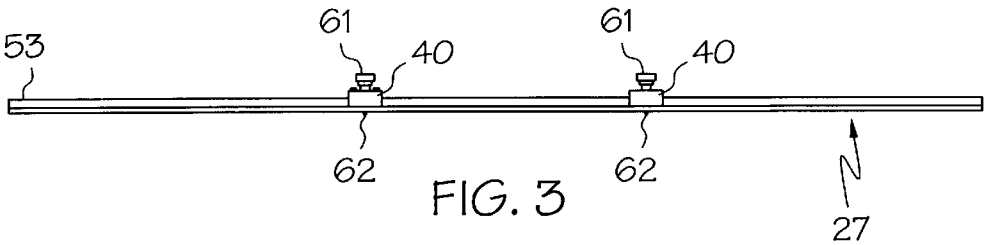
FIG. 3 shows a front view of the straight edge.
Figure 10:
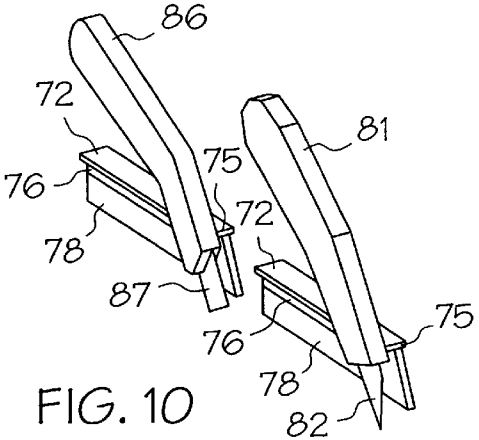
FIG. 10 shows a right hand cutting member fixed with a carpet knife and a right hand cutting member fixed with a vinyl knife.
Figure 9:
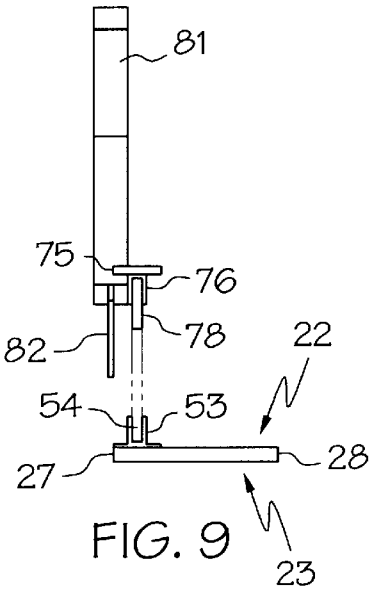
FIG. 9 shows a side view of the straight edge and a right hand cutting member.
Figure 7:
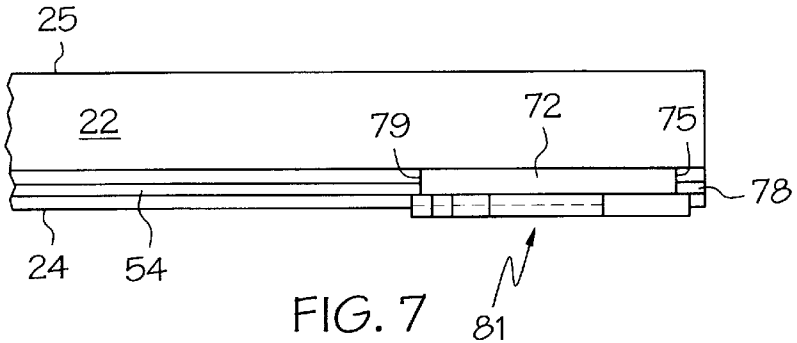
FIG. 7 shows a top view of the straight edge and right hand cutting member.
Figure 8:
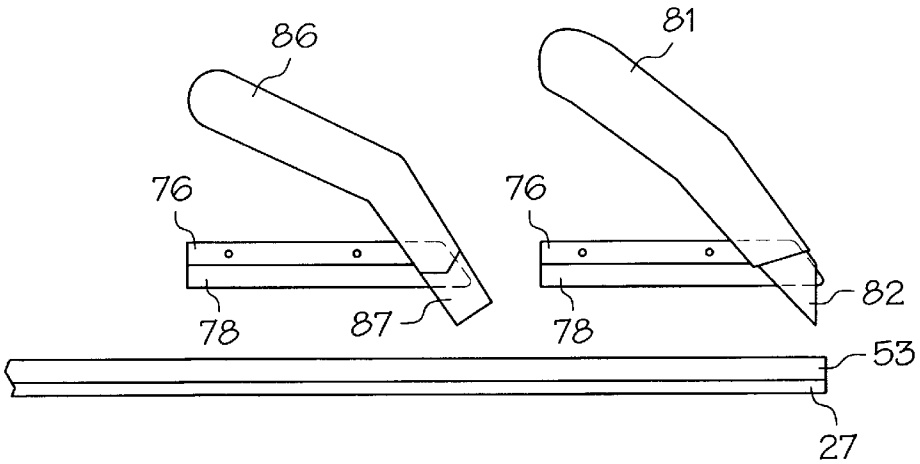
FIG. 8 shows a front view of the straight edge and a right hand cutting member with a carpet knife and a right hand cutting member with a vinyl knife.
Figure 14:
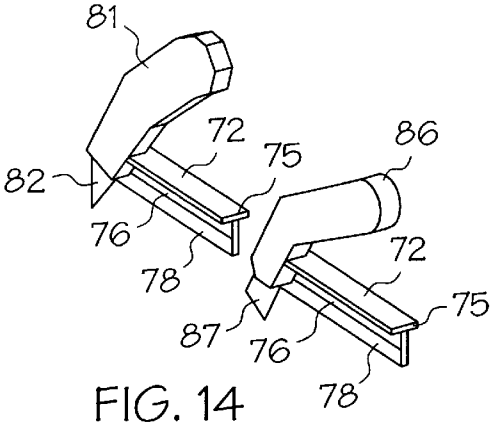
FIG. 14 shows a left hand cutting member fixed with a carpet knife and a left hand cutting member fixed with a vinyl knife.
Figure 13:
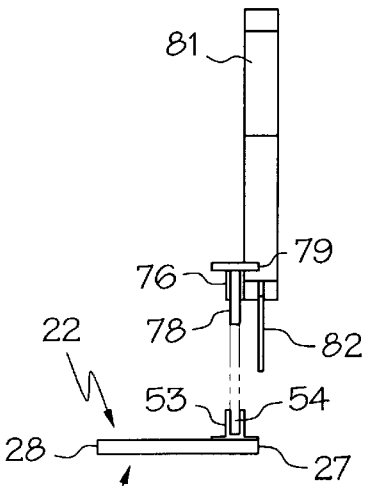
FIG. 13 shows a side view of the straight edge and a left hand cutting member.
Figure 11:
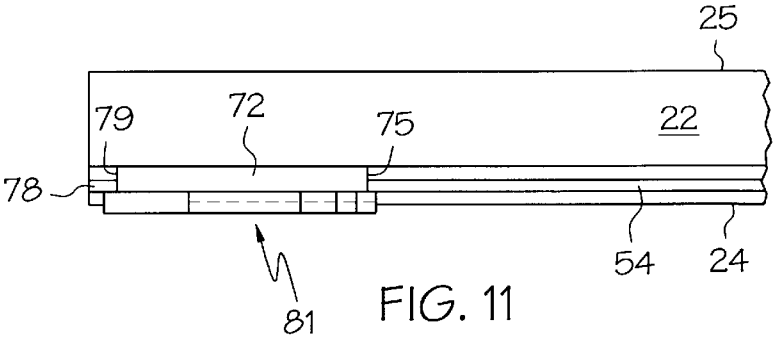
FIG. 11 shows a top view of the straight edge and a left hand cutting member.
Figure 12:
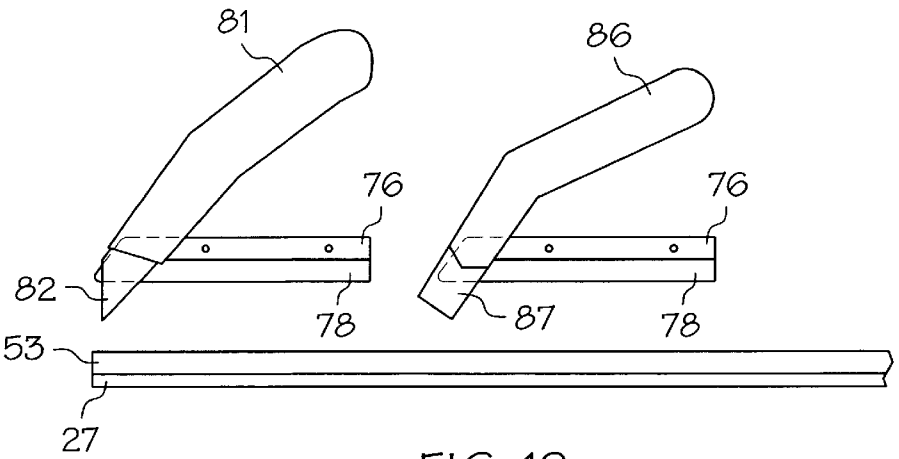
FIG. 12 shows a front view of the straight edge and a left hand cutting member fixed with a carpet knife and a left hand cutting member fixed with a vinyl knife.

FIGS. 1, 2, 3, 4, 5 and 6, shows at least two stabilizing members 40 which are rectangular in shape. As shown in FIG. 5, each stabilizing member 40 has a top surface 41, a bottom surface 42 and a centrally located threaded aperture 43. The top surface 41 of each stabilizing member 40 has at least two wells 45, one well 45 on each side of the centrally located threaded aperture 43. Within each well 45 is an aperture 44 extending through stabilizing member 40 to the bottom surface 42 of the stabilizing member 40. Each aperture 44 within well 45 is in axial alignment with a threaded aperture 29 of metal base 21. The bottom surface 42 of each stabilizing member 40 is fixed to the top surface 22 of metal base 21 by means of a threaded bolt 46 and a nut 47. The threaded bolt 46 extends upwardly through a threaded aperture 29 in the bottom surface 23 of the metal base 21 and extends through aperture 44 to engage nut 47 seated within well 45. In the preferred version, each stabilizing member 40 is integral with metal base 21 and extends upwardly from the top surface 22 of metal base 21 with the centrally located threaded aperture 43 of each stabilizing member 40 extending from the top surface 41 of stabilizing member 40 to the bottom surface 23 of the metal base 21.

FIGS. 1, 2, 3, 4, 5 and 6, shows a positioning pin 60. The purpose of the positioning pin 60 is to hold the bottom surface of the metal base 21 to the carpet being cut so that the straight edge 27 or 28 of the metal base 21 does not move as the carpet is being cut. Each positioning pin 60 comprises a knob 61 at one end and at the other end a piercing end 62. Each positioning pin 60 further comprises a threaded area 63 between knob 61 and piercing end 62. Threaded area 63 of positioning pin 60 engages the centrally located threaded aperture 44 of stabilizing member 40 such that knob 61 and locking means 64, comprising a nut, are above the top surface 41 of the stabilizing member 40 and piercing end 62 extends below the bottom surface 23 of the metal base 21.

FIGS. 1, 2, 4, 5, 6, 7, 8, 9, 11, 12 and 13, shows a first guidance track 50 extending the entire length of metal base 21. The first guidance track 50 has a top surface 51 and a bottom surface 52. The bottom surface 52 of the first guidance track 50 is removably fixed to to top surface 22 of the metal base 21 between the front portion 24 of the metal base 21 and the stabilizing members 40. The first guidance track 50 has at least two side walls 53 extending upwardly from the top surface 51 of the first guidance track 50. These side walls 53 are spaced apart from each other and form a channel 54 there between. The first guidance track 50 is removably fixed to the top surface 22 of metal base 21 by means 56 of screws extending downwardly through threaded apertures 55 in the top surface 51 of first guidance track 50. These means 56 of screws engage threaded apertures 29 in the top surface 22 of metal base 21 and secures bottom surface 52 of first guidance track 50 to the top surface 22 of metal base 21. In the preferred version, the first guidance track 50 is integral with the top surface 22 of the metal base 21 and at least two side walls 53 extend upwardly from the top surface 22 of the metal base 21. These side walls 53 are spaced apart from each other and form a channel 54 there between.

FIGS. 1, 7, 8, 9, 10, 11, 12, 13 and 14, shows different versions of the cutting member 70. More than one version of the cutting member 70 is required depending on the type of material being cut and whether the installer is right handed or left handed. Each cutting member 70 comprises a second guidance track 71 similar to the first guidance track 50 except the second guidance track 71 is smaller in length and inverted. The second guidance track 71 has a top surface 72, a bottom surface 73, a front portion 74 and ends 75 and 79. There are at least two side walls 76 extending downwardly from the bottom surface 73 of the second guidance track 71. These side walls 76 are spaced apart from one another and form a channel 77 there between. A glide member 78 is fixed within the channel 77 of the second guidance track 71 and extends downwardly past each side wall 76. One version of cutting member 70 comprises a carpet knife 80 having an adjustable blade 82 at one end and a handle 81 at the opposite end. The carpet knife 80 is attached to the front portion 74 of the second guidance track 71 between the handle 81 and the adjustable blade 82. The handle 81 of the carpet knife 80 angles downwardly towards the top surface 72 of the second guidance track 71. The carpet knife 80 in the right hand version is attached to the second guidance track 71 at an L-shaped cut out 84 in the front portion 74 at end 75 of the second guidance track 71. The carpet knife 80 in the left hand version is attached to the second guidance track 71 at an L-shaped cut out 84 in the front portion 74 at end 79 of the second guidance track 71. Another version of cutting member 70 comprises a vinyl knife 85 having a stronger adjustable blade 83 at one end and a handle 86 at the opposite end. The vinyl knife 85 is attached to the front portion 74 of the second guidance track 71 between handle 86 and the stronger adjustable blade 83. The handle 86 of the vinyl knife 85 angles downwardly towards the top surface 72 of the second guidance track 71. In the preferred version, vinyl knife 85 has a stronger fixed blade 87 at one end and handle 86 at the opposite end. The vinyl knife 85 in the right hand version is attached to the second guidance track 71 at L-shaped cut out 84 in the front portion 74 at end 75 of the second guidance track 71. The vinyl knife 85 in the left hand version is attached to the second guidance track 71 at L-shaped cut out 84 in the front portion 74 at end 79 of the second guidance track 71.

To use the device of the instant application for cutting straight edges, the bottom surface 23 of the metal base 21 is placed on the material being cut. The straight edge 27 of the front portion 24 of the metal base 21 is placed adjacent to the line of cut. When cutting carpet, a positioning pin 60 is screwed into the centrally located threaded aperture 43 of each stabilizing member 40 by turning knob 61 of positioning pin 60 until piercing end 62 of positioning pin 60 secures metal base 21 to the carpet being cut. The means for locking 64, comprising a nut, is screwed down to the top surface 41 of stabilizing member 40. When cutting vinyl or linoleum floor coverings, the non-slip rubber coating 30 on the bottom surface 23 of the metal base 21 prevents the metal base 21 from moving during the cutting process; therefore, positioning pins 60 are not required. Positioning pins 60 may be used when cutting vinyl or linoleum floor coverings; however, piercing end 62 will leave an indentation in the surface of the floor coverings. The handle end of the glide member 78 of the cutting member 70 is inserted into channel 54 of the first guidance track 50. Once the glide member 78 is within the channel 54, the cutting edge of blade 82, 83 or 87 rests along the straight edge 27 of the front portion 24 of the metal base 21. In order to cut the material, the installer grasps the handle 81 or 86 of the cutting member 70 and pulls the cutting member 70 down the length of the first guidance track 50. The side walls 53 of the first guidance track 50 restricts the glide member 78 within the channel 54 of the first guidance track 50 thereby preventing lateral movement of blade 82, 83 or 87 as blade 82, 83 or 87 slides along the straight edge 27.

The device is particularly useful when joining two edges of carpet together to form a seam. Before the two edges of carpet are brought together, the installer rolls back the carpet edge to expose the secondary backing of the carpet. The installer places the bottom surface 23 of the metal base 21 between the carpet edge and the edge of where the melt tape will be applied. This usually results in the front portion 24 of the metal base 21 being positioned about ¾ of an inch from the edge of the carpet. A positioning pin 60 is screwed into the centrally located threaded aperture 43 of each stabilizing member 40 and the means for locking 64 is screwed down to the top surface 41 of each stabilizing member 40. The installer will select the cutting member 70 with carpet knife 80 and adjustable blade 82. It is critical that the installer adjust the length of the blade 82 so that the secondary backing of the carpet is scored. If the blade 82 cuts into the primary backing of the carpet, where the carpet yarn is attached, the carpet yarn has the potential to unravel. Once the appropriate length of the blade 82 has been determined, the installer will insert the handle end of glide member 78 of the cutting member 70 into the channel 54 of the first guidance track 50. This will cause the blade 82 of the carpet knife 80 to rest along the straight edge 27 of the front portion 24 of the metal base 21. The installer can score the primary carpet backing by grasping the handle 81 of the cutting member 70 and pulling the cutting member 70 down the appropriate length of the first guidance track 50. The glide member 78 is removed from the first guidance track 50, the locking means 64 is screwed up from the top surface 41 of each stabilizing member 40 and the positioning pin 60 is removed from the centrally located threaded aperture 43 of each stabilizing member 40. The metal base 21 is removed from the carpet backing and the scoring method is either continued on the same piece of carpet or performed on the adjoining piece of carpet.

Once each adjoining carpet edge has been scored, the installer can apply the melt tape with the use of an iron and butt the carpet edges together to form a visibly undetectable carpet seam. By scoring the secondary backing of the carpet near the carpet edge, the stress formed at the seam when the two carpet edges are brought together is transferred to the score; thus, allowing the two adjoining edges of carpet to lay flat next to each other at the seam. As the adhesive from the melt tape cools, the adhesive will not only seal the score in the secondary backing of the carpet but also seal the two adjoining edges of carpet together so that the newly formed seam is visibly undetectable.

I claim:

1. A straight edge guidance cutting system for cutting carpet, vinyl and linoleum floor coverings and sheet goods comprising:

an elongated metal base having a front portion, a rear portion and opposite ends, said metal base further having a top surface and a bottom surface, said front portion and said rear portion of said metal base having a straight edge; at least two threaded apertures between the ends of said metal base, said threaded apertures extending from the top surface of said metal base to the bottom surface of said metal base; a non-slip rubber coating on said bottom surface of said metal base between said front portion and said rear portion of said metal base; at least two removable stabilizing members, each of said stabilizing members having a top surface and a bottom surface, a centrally located threaded aperture extending through each of said stabilizing members from the top surface of said stabilizing member to the bottom surface of said stabilizing member, and each of said stabilizing members removably fixed to said top surface of said metal base such that said centrally located threaded aperture of said stabilizing member is axially aligned with a respective threaded aperture of said metal base; means for removably securing each of said stabilizing members to said top surface of said metal base; at least two positioning pins each having a knob at one end and at the opposite end a piercing end, said positioning pin further having a threaded area between said piercing end and said knob, said positioning pin extending through said centrally located threaded aperture of said stabilizing member and said threaded aperture of said metal base with the knob of said positioning pin above said top surface of said stabilizing member and said piercing end of said positioning pin extending below said bottom surface of said metal base; a means for locking said positioning pin into a fixed position between said top surface of said stabilizing member and said knob of said positioning pin; a first guidance track having a base, said base of said first guidance track having a top surface and a bottom surface, said bottom surface of said first guidance track removably fixed to said top surface of said metal base between said front portion of said metal base and said stabilizing members, said first guidance track extending the entire length of said metal base, and said top surface of said first guidance track having at least two side walls extending upwardly and spaced apart from one another forming a channel there between; a cutting member comprising a second guidance track and a carpet knife, said second guidance track having a top surface and a bottom surface, said second guidance track further having a front portion, a rear portion and opposite ends, at least two side walls spaced from one another and extending downwardly from said bottom surface of said second guidance track forming a channel there between, a glide member permanently fixed within said channel of said second guidance track, said glide member further extending downwardly from said bottom surface of said second guidance track past each of said side walls of said second guidance track, said carpet knife fixed to said second guidance track at said front portion of an end of said second guidance track, said carpet knife having a handle at one end and at the opposite end an adjustable blade, said carpet knife being fixed to said second guidance track between said adjustable blade and said handle with said handle angled downwardly toward said top surface of said second guidance track; and when said glide member of said second guidance track of said cutting member is inserted into said channel of said first guidance track of said metal base, said glide member of said cutting member slides within said channel of said first guidance track of said metal base, and said side walls of said first guidance track of said metal base prevents lateral movement of said cutting member as said adjustable blade of said carpet knife rests along said straight edge of said front portion of said metal base with said adjustable blade extending below said bottom surface of said metal base at a sufficient depth to cut or score the appropriate material.

2. The device of claim 1 wherein: said metal base is from about 4 to 6 feet in length.

3. The device of claim 2 wherein: said cutting member further comprises an L-shaped cut out in said top surface of said front portion at one end of said second guidance track, and said carpet knife being fixed to said second guidance track at said L-shaped cut out between said adjustable blade and said handle whereby said handle of said carpet knife is positioned such that said cutting member may be used by a right handed installer.

4. The device of claim 3 wherein: said cutting member further comprises an L-shaped cut out in said top surface of said front portion at an opposite end of said second guidance track, and said carpet knife fixed to said second guidance track at said L-shaped cut out between said adjustable blade and said handle whereby said handle of said carpet knife is positioned such that said cutting member may be used by a left handed installer.

5. The device of claim 3 wherein: said cutting member comprises a vinyl knife, said vinyl knife having a stronger adjustable blade at one end and a handle at the opposite end.

6. The device of claim 4 wherein: said cutting member comprises a vinyl knife, said vinyl knife having a stronger adjustable blade at one end and a handle at the opposite end.

7. The device of claim 5 wherein: said vinyl knife having a stronger fixed blade at one end and a handle at the opposite end.

8. The device of claim 6 wherein: said vinyl knife having a stronger fixed blade at one end and a handle at the opposite end.

9. A straight edge guidance cutting system for cutting carpet, vinyl and linoleum floor coverings and sheet goods comprising:

an elongated metal base having a front portion, a rear portion and opposite ends, said metal base further having a top surface and a bottom surface, said front portion and said rear portion of said metal base having a straight edge; at least two threaded apertures between the ends of said metal base, said threaded apertures extending from the top surface of said metal base to the bottom surface of said metal base; a non-slip rubber coating on said bottom surface of said metal base between said front portion and said rear portion of said metal base; at least two stabilizing members integral with said top surface of said metal base, each of said stabilizing members having a top surface and a centrally located threaded aperture extending there through, and each of said stabilizing members positioned such that said centrally located threaded aperture of said stabilizing member is axially aligned with a respective threaded aperture of said metal base; at least two positioning pins each having a knob at one end and at the opposite end a piercing end, said positioning pin further having a threaded area between said piercing end and said knob, said positioning pin extending through said centrally located threaded aperture of said stabilizing member and said threaded aperture of said metal base with said knob of said positioning pin above said top surface of said stabilizing member and said piercing end of said positioning pin extending below said bottom surface of said metal base; a means for locking said positioning pin into a fixed position between said top surface of said stabilizing member and said knob of said positioning pin; a first guidance track comprising at least two side walls integral with and extending upwardly from said top surface of said metal base between said front portion of said metal base and said stabilizing members, said side walls being spaced from one another forming a channel there between, and said first guidance track extending the entire length of said metal base; a cutting member comprising a second guidance track and a carpet knife, said second guidance track having a top surface and a bottom surface, said second guidance track further having a front portion, a rear portion and opposite ends, at least two side walls spaced from one another and extending downwardly from the bottom surface of said second guidance track forming a channel there between, a glide member permanently fixed within said channel of said second guidance track, said glide member further extending downwardly from said bottom surface of said second guidance track past each side wall of said second guidance track, a carpet knife fixed to said second guidance track at said front portion of an end of said second guidance track, said carpet knife having a handle at one end and at the opposite end an adjustable blade, said carpet knife being fixed to said second guidance track between said adjustable blade and said handle with said handle angled downwardly towards said top surface of said second guidance track; and when said glide member of said second guidance track of said cutting member is inserted into said channel of said first guidance track of said metal base, said glide member of said second guidance track of said cutting member slides within said channel of said first guidance track of said metal base, and said side walls of said first guidance track of said metal base prevents lateral movement of said cutting member as said adjustable blade of said carpet knife rests along said straight edge of said front portion of said metal base with said adjustable blade extending below said bottom surface of said metal base at a sufficient depth to cut or score the appropriate material.

10. The device of claim 9 wherein: said metal base is from about 4 to 6 feet in length.

11. The device of claim 10 wherein: said cutting member further comprises an L-shaped cut out in said top surface of said front portion at one end of said second guidance track, and said carpet knife being fixed to said second guidance track at said L-shaped cut out between said adjustable blade and said handle whereby said handle of said carpet knife is positioned such that said cutting member may be used by a right handed installer.

12. The device of claim 11 wherein: said cutting member further comprises an L-shaped cut out in said top surface of said front portion at an opposite end of said second guidance track, and said carpet knife fixed to said second guidance track at said L-shaped cut out between said adjustable blade and said handle whereby said handle of said carpet knife is positioned such that said cutting member may be used by a left handed installer.

13. The device of claim 11 wherein: said cutting member comprises a vinyl knife, said vinyl knife having a stronger adjustable blade at one end and a handle at the opposite end.

14. The device of claim 12 wherein: said cutting member comprises a vinyl knife, said vinyl knife having a stronger adjustable blade at one end and a handle at the opposite end.

15. The device of claim 13 wherein: said vinyl knife having a stronger fixed blade at one end and a handle at the opposite end.

16. The device of claim 14 wherein: said vinyl knife having a stronger fixed blade at one end and a handle at the opposite end.

* * * * *